US005681183A

United States Patent [19]

Dzmura

[11] Patent Number: 5,681,183

[45] Date of Patent: Oct. 28, 1997

[54] ACCESSIBLE VCR JACK ASSEMBLY

[76] Inventor: Paul A. Dzmura, 6943 W. Old Ridge Rd., Fairview, Pa. 16415

[21] Appl. No.: 724,191

[22] Filed: Oct. 1, 1996

Related U.S. Application Data

[60] Provisional application No. 60/004,928, Dec. 10, 1995.

[51] Int. Cl.[6] ..... H01R 11/00

[52] U.S. Cl. ..... 439/502; 439/639; 439/491

[58] Field of Search ..... 439/502, 578, 439/540.1, 701, 638, 639, 640

[56] References Cited

U.S. PATENT DOCUMENTS

| | | | |
|---|---|---|---|
| 3,989,338 | 11/1976 | Gosser | 439/491 |
| 4,740,172 | 4/1988 | Tubbs | 439/653 |
| 4,998,343 | 3/1991 | Costello | 439/491 |
| 5,209,678 | 5/1993 | Allen et al. | 439/672 |
| 5,307,416 | 4/1994 | Martin | 381/77 |
| 5,511,995 | 4/1996 | Cheng | 439/638 |

*Primary Examiner*—Neil Abrams
*Assistant Examiner*—T. C. Patel

[57] ABSTRACT

An accessible jack assembly for a video cassette recorder (VCR), allowing access to audio/video jacks located in the rear panel of the VCR from the front of the VCR. In preferred embodiments, the jack assembly comprises a mounting frame having jacks for audio and video output cables, at least one plug for insertion in the jacks in the rear panel of the VCR, and at least one cable connecting the mounting frame with said plug. The mounting frame may be attached to the front upper surface of the VCR to allow easy access. The jacks on the mounting frame may be color-coded by the user with circular stick-on labels. The invention may also be used with types of electronic equipment other than VCRs.

16 Claims, 3 Drawing Sheets

ACCESSIBLE VCR JACK ASSEMBLY

BACKGROUND OF THE INVENTION

1. Field of the Invention

The invention relates to jacks and, more particularly, to a jack assembly for allowing access to audio/video jacks located in the rear panel of a video cassette recorder (VCR) from the front of the VCR.

2. Background and Description of the Prior Art

Cables to VCRs must often be connected to a rear panel of the VCR. This can be very inconvenient for someone who frequently connects and disconnects cables, as when patching from a camcorder or other telecommunications device. The present invention allows the user to conveniently plug cables into a jack assembly adjacent to the front panel of the VCR. There are numerous inventions in the prior art for making electrical connections, but none are equivalent to the instant invention in providing an apparatus attached to the top of a VCR or other electrical or electronic device, that conveniently allows a connection to plugs at the back of the VCR or other device to be made at the front.

U.S. Pat. No. 4,904,199, issued to Francis L. Ducassou, on Feb. 27, 1990, discloses a support for a detachable junction between two or more cables, which has a cover that can be locked around the place where the cables are connected, to prevent their being disconnected without unlocking the cover. Unlike the instant invention, it does not itself include plugs, sockets, or a cable suitable for making a connection between the front and back of a VCR.

U.S. Pat. No. 5,002,502 issued to Robert D. Hill on Mar. 26, 1991, discloses a wall plate assembly for coupling a satellite television disk antenna multiconductor cable array to tuner/receiver cables.

U.S. Pat. No. 5,129,842 issued to Stuart K. Morgan and Michael Romm on Jul. 14, 1992 discloses a modular patch panel, with a snap-together frame that retains a plurality of faceplates adapted to receive modules which hold electrical elements such as plugs and connectors.

U.S. Pat. No. 5,209,678 issued to Brian J. Allen and Duane B. Kutsch on May 11, 1993 discloses a telecommunications from access coaxial jack and plug assembly with a releasable locking feature. It is distinguishable from the instant invention, in that it is a means for placing the access on the from originally, rather than allowing from access to a rear panel.

U.S. Pat. No. 5,246,378 issued to Aurel Seiceanu on Sep. 21, 1993 discloses a coaxial jack assembly, which, unlike the instant invention, does not include a cable with a plug extending from the assembly to allow access to a rear panel of a VCR from the front.

U.S. Pat. No. 5,271,590 issued to John B. Rosen, on Dec. 21, 1993 discloses an articulable projecting plug, which, unlike the instant invention, includes pivotally connected mechanical extensions.

U.S. Pat. No. 5,370,553 issued to Joel A. Zimmerman, on Dec. 6, 1994, discloses a housing for telecommunications equipment having a vertical passageway with racks for holding the equipment. This is designed to be mounted on or against a wall, but would not be suitable for mounting on top of a VCR.

French Patent No. 1.481.921 published May 1967, disclosed mounting for a plug for a television antenna.

German Patent No. 37 34 702 published Jan. 1989, disclosed a mounting frame for coaxial cable plugs. None of the above inventions and patents, taken either singly or in combination, is seen to describe the instant invention as claimed.

SUMMARY OF THE INVENTION

Accordingly, it is a principal object of the invention to provide a device for conveniently accessing plugs for coaxial cables located on the rear of a VCR from the front of the VCR.

It is another object of the invention to provide a means for conveniently accessing plugs for cables located on the rear or sides of any electrical or electronic device from the front.

It is a further object of the invention to provide means, in alternative embodiments of the invention, for accessing varying numbers of plugs for cables located on the rear or sides of any electrical or electronic device from the front.

It is still a further object of the invention to provide a means for conveniently color coding plugs for cables, by using variously colored circular stick-on labels that fit around the plugs on the adjacent surface in which the plugs are embedded.

It is an object of the invention to provide improved elements and arrangements thereof in an apparatus for the purposes described which is inexpensive, dependable and fully effective in accomplishing its intended purpose.

These and other objects of the present invention will become readily apparent upon further review of the following specification and drawings.

BRIEF DESCRIPTION OF DRAWINGS

Similar reference characters denote corresponding features consistently throughout the attached drawings.

LIST OF NUMBERED PARTS

Figure 1:
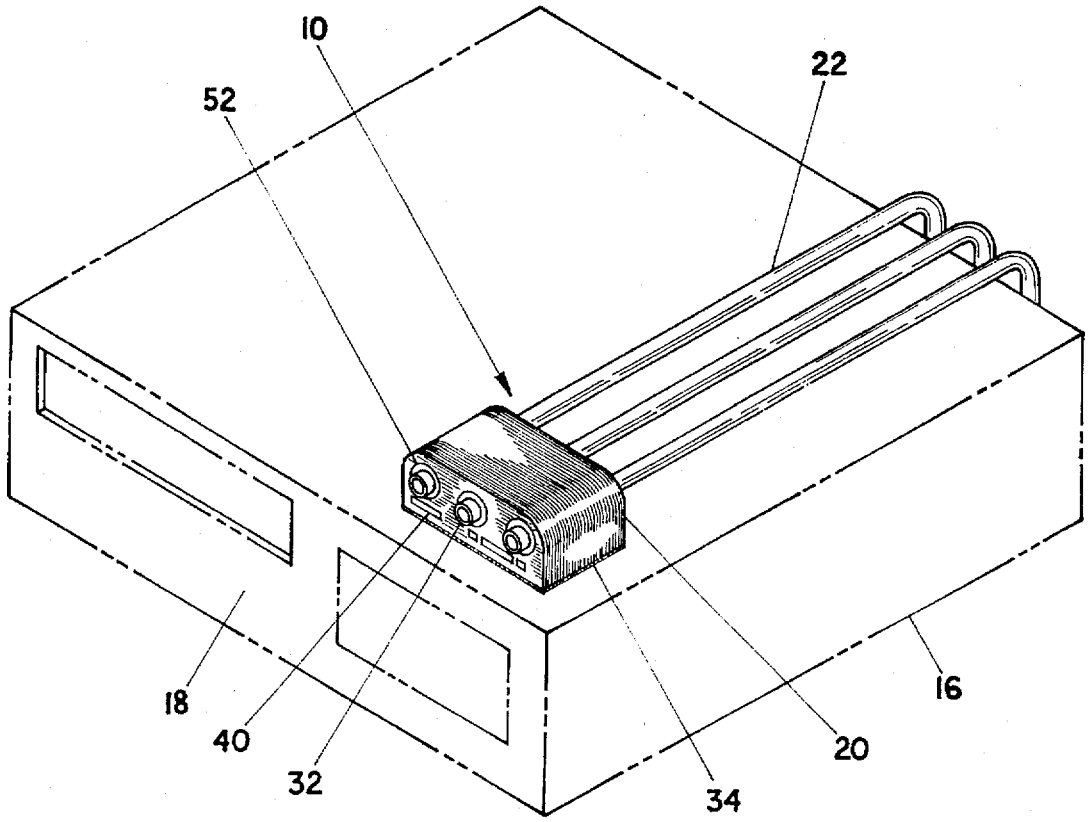
FIG. 1 is an environmental perspective view of a first embodiment of the invention, showing it resting on a video cassette recorder.

10 video cassette recorder (VCR) jack assembly
12 audio/video (A/V) jacks
14 rear panel of VCR
16 VCR
18 front of VCR
20 mounting frame
22 cable
24 plug
26 jack

28 rear end of cable
30 front end of cable
32 contact sockets
34 bottom surface of mounting flame
36 jack coupler
38 front plug
40 rectangular labels
42 top section of mounting frame
44 bottom section of mounting frame
46 screws
48 vertical clearance holes
50 vertical apertures
52 circular labels
56 holes
58 clearance holes
60 electronic device

DETAILED DESCRIPTION OF THE PREFERRED EMBODIMENTS

Figure 2:
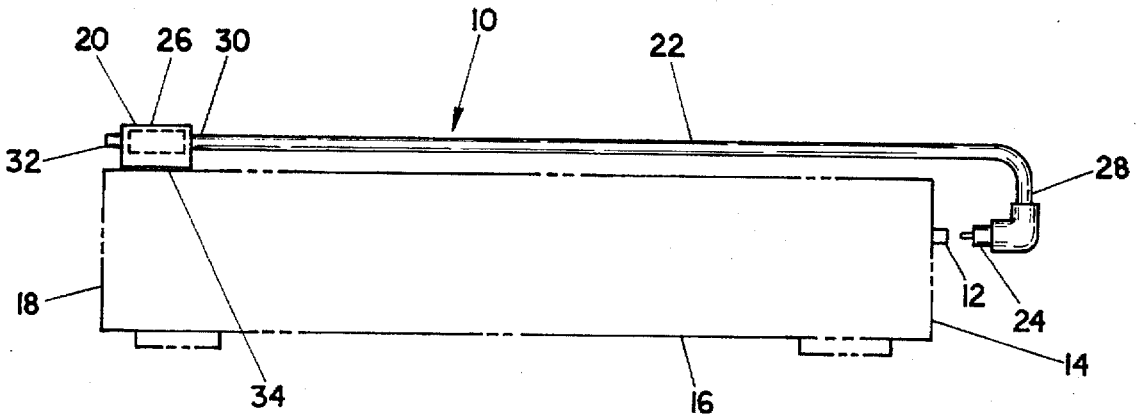
FIG. 2 is an environmental elevational side view of the first embodiment of the invention, showing it resting on a video cassette recorder.

A VCR jack assembly 10 for allowing access to audio/video (AN)jacks 12 located in the rear panel 14 of a video cassette recorder (VCR) 16 from the front 18 of the VCR is shown in FIGS. 1 and 2. The rear panel of a VCR typically includes a set of AN jacks to allow the VCR to be connected to another VCR or a camcorder for the purpose of copying or "dubbing" video tapes. This arrangement requires a user to reach behind the VCR or mm the VCR to access the rear panel and the A/V jacks. The present invention facilitates making connections to the AN jacks by providing access to the jacks from the from of the VCR.

With further reference to FIGS. 1 and 2, the main components of the VCR jack assembly 10 include a mounting frame 20, a cable 22, a plug 24, and a jack 26. The plug 24 is configured to matingly engage one of the AN jacks 12. The rear end 28 of the cable 22 is connected to the plug 24. Preferably, the plug 24 is a right angle plug, having the rear end 28 of the cable 22 permanently attached thereto, as shown in FIG. 2. Alternatively, the plug 24 may be a linear plug or a fight angle plug adaptor, such as Radio Shack Catalog Part No. 274-306, having a separate jack for matingly engaging a corresponding linear plug 24 which is permanently affixed to the rear end 28 of the cable 22. Preferably, both the plug 24 and the jack 26 are gold-plated to improve conductivity.

The jack 26 is permanently affixed to the front end 30 of the cable 22. The jack 26 is configured to matingly receive a plug (not shown) connected to an external device such as a camcorder or a second VCR. The jack 26 is permanently embedded within mounting frame 20 such that only the contact socket 32 portion of the jack 26 is exposed. The bottom surface 34 of the mounting frame 20 is provided with an adhesive, for example, foam tape or contact cement, such that the mounting frame 20 may be securely affixed to the top surface of the VCR proximate the front 18 of the VCR. If contact cement is provided, a removable paper backing may be used to shield the cement until the mounting frame 20 is ready to be affixed to the VCR top.

The number of A/V jacks provided with a VCR varies depending on whether the VCR has the ability to playback and record audio signals in stereo. A stereo VCR includes two output jacks for audio signals as well as two input jacks for audio signals. Conversely, a mono-VCR includes only a single output jack and a single input jack for audio signals. In addition, various video jacks may be present such as an RCA jack or a coaxial jack. One skilled in the art will appreciate that the VCR jack assembly 10 may include multiple components (i.e., multiple cables 22, plugs 24, and jacks 26) corresponding in number to the number of A/V jacks present on the VCR. Thus, the VCR jack assembly 10 may be configured to provide access to all the A/V jacks (both audio and video jacks and both input and output jacks) present on a VCR.

Figure 3:
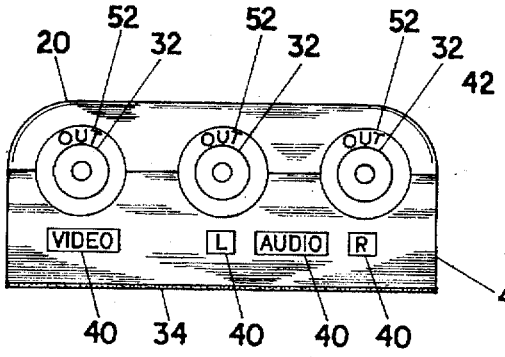
FIG. 3 is a front elevational view of a second embodiment of the invention.
Figure 4:
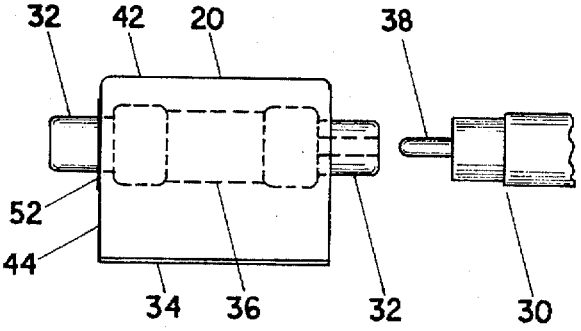
FIG. 4 is a side elevational view of the second embodiment of the invention.

Referring to FIGS. 3 and 4, a second embodiment of the VCR jack assembly 10 is shown. A jack coupler 36 is secured within the mounting frame 20 such that the opposing contact sockets 32 are exposed. Preferably, the jack coupler 36 is a linear jack coupler, such as Radio Shack Catalog Part No. 274-874. At one end, the jack coupler 36 is configured to matingly receive a front plug 38 which is permanently affixed to the second end 30 of the cable 22. At the opposing end, the jack coupler 36 is configured to matingly receive a plug (not shown) connected to an external device such as a camcorder, a second VCR, or a laser disc device.

The mounting flame 20 shown in FIG. 3 is configured for use with a stereo VCR. Three jack couplers 36 are provided to accommodate the video output jack and the two audio jacks. The jack couplers 36 are aligned in parallel along a horizontal axis passing through the mounting frame 20. Rectangular labels 40 are provided to indicate each of the A/V jacks to which the jack couplers 36 are connected.

The mounting flame 20 may be made of molded plastic or a similar material, with the jack coupler 36 being molded integral with the mounting block 20. Alternatively, the mounting frame 20 may be molded into two sections, a top section 42 and a bottom section 44. Mating channels are provided within the top section 42 and the bottom section 44, respectively, to accommodate the jack couplers 36. The channels form cylindrical apertures of varying diameters when the top section 42 and the bottom section 44 are joined. (The channels are not shown because they have the same outline as the jack couplers 36.) The top section 42 and bottom section 44 may be fastened to one another by any well known fastening means, such as glue, screws, or self-locking tabs formed during the molding of the mounting frame 20.

Figure 5:
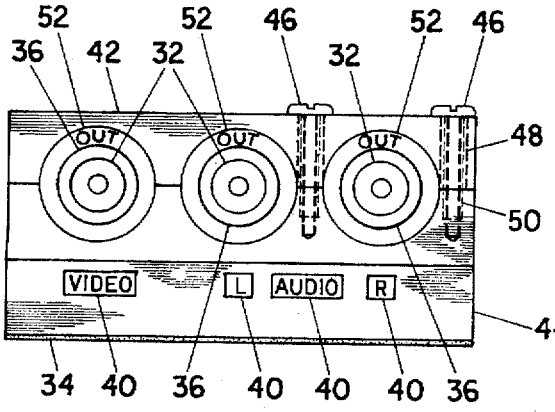
FIG. 5 is a front elevational view of a third embodiment of the invention.
Figure 6:
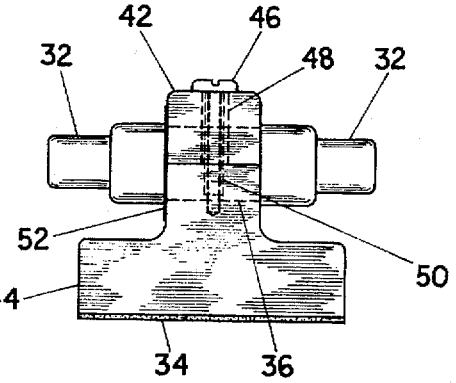
FIG. 6 is a side elevational view of the third embodiment of the invention.

Referring to FIGS. 5 and six, a third embodiment of the VCR jack assembly 10 is shown in which the mounting frame 20 is T-shaped in cross section. Preferably, the mounting frame 20 of the third embodiment is formed into two sections, a top section 42 and a bottom section 44, through the extrusion process of materials with plastic qualities. Mating channels are provided within the top section 42 and the bottom section 44, respectively, to accommodate jack couplers 36. The channels form cylindrical apertures when the top section 42 and the bottom section 44 are joined. Preferably, the top section 42 and the bottom section 44 are fastened to one another by screws 46. The screws 46 pass through vertical clearance holes 48 in the top section 42 and threading ly engage vertical apertures 50 in the bottom section 44. Circular labels 52 are attached to the front face of the mounting frame 20 around the jack couplers 36. Preferably, the circular labels 52 identify the jack couplers by color and by a jack's electrical signal direction printed at least once on the color side of the label. Even more preferably, yellow is used to indicate the video jack, red to indicate the fight audio jack, and white to indicate the left audio jack, in accordance with industry standards.

Figure 7:
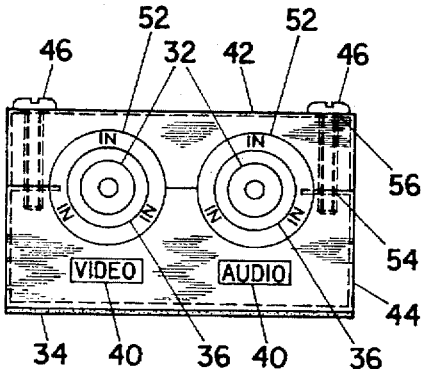
FIG. 7 is a front elevational view of a fourth embodiment of the invention.
Figure 8:
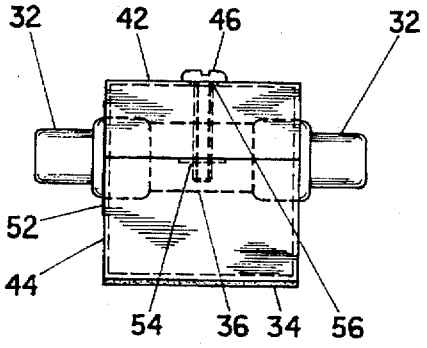
FIG. 8 is a side elevational view of the fourth embodiment of the invention.

Referring to FIGS. 7 and eight, a fourth embodiment of the VCR jack assembly 10 is shown in which the mounting frame 20 is configured for use with a mono-VCR. Two jack couplers 36 are provided to accommodate the video output jack and the audio output jack of a mono-VCR. The jack couplers 36 are aligned in parallel along a horizontal axis passing through the mounting frame 20. Circular labels 52 are attached to the front face of the mounting frame 20 around the jack couplers 36. Preferably, yellow is used to indicate the video jack and red to indicate the audio jack, in accordance with industry standards.

Preferably, the mounting frame 20 of the fourth embodiment is constructed of sheet metal and formed into two sections, a top section 42 and a bottom section 44. Mating cutouts are provided within the top section 42 and the bottom section 44, respectively, to accommodate the jack couplers 36. The cutouts form cylindrical openings when the top section 42 and the bottom section 44 are joined. Preferably, the top section 42 and the bottom section 44 are fastened to one another by screws 46. The screws 46 threadingly engage holes 54 in the bottom section 44 through clearance holes 56 in the top section 42.

Preferably, the VCR jack assembly 10 would be provided to the user in the form of a kit for retrofitting on existing VCRs, or sold to the user with a new VCR or camcorder. In operation, the user affixes the mounting frame 20 to the top surface of the VCR 16 proximate the front of the VCR 18 and connects the plugs 24 provided to the A/V jacks 12 located at the rear panel 14 of the VCR 16. Thus, the user is free to make connections to the jacks 26 proximate the front of the VCR 18 and thereby gain access to the A/V jacks 12 at the rear of the VCR 14 from the from of the VCR 18.

The circular labels 52 may be made of paper with an adhesive backing. The labels have concentric circular holes with the same radius as the jack couplers 36, so that they fit around said jack couplers. A plurality of the labels 52, in a variety of colors, may be provided to the consumer on cardboard or plastic sheets from which they can be peeled off. It is contemplated that the labels 52 may be sold either together with the jack assembly 10 or separately. Alternatively, said circular labels 52 may come in shapes other than circular, with appropriately shaped and sized holes to fit around a variety of electrical outlets.

Figure 9:
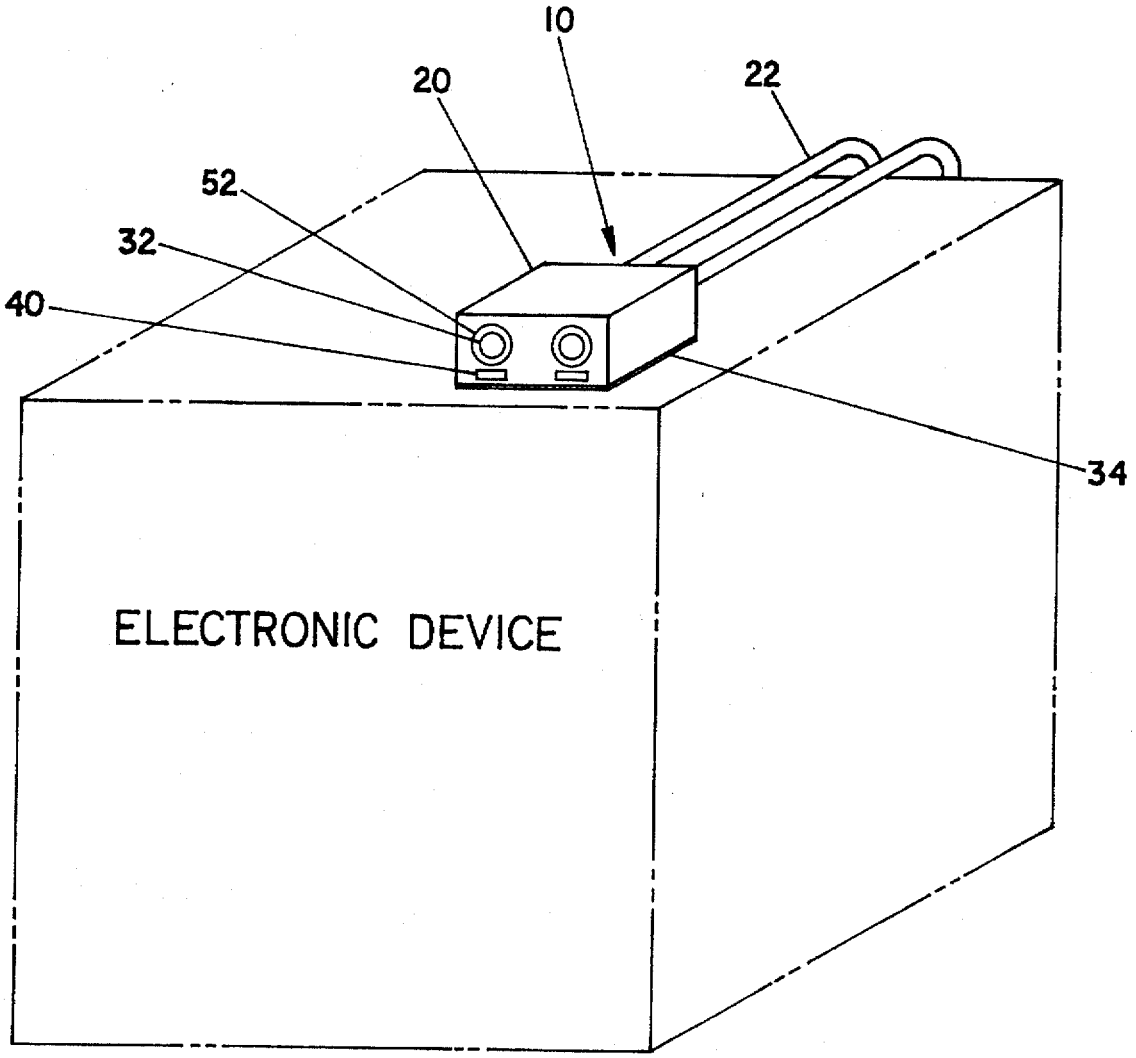
FIG. 9 is an environmental perspective view of a typical embodiment showing it resting on an electronic device.

Referring to FIG. 9, it is to be understood that the present invention is not limited to the embodiments described above, but encompasses any and all embodiments within the scope of the following claims. In particular, the invention may be used and/or adapted to provide a means for conveniently accessing plugs for cables located on the rear or sides of any electrical or electronic device 56 from the front of the device.

I claim:

1. A jack assembly for use with an electrically powered device having a rear side device socket, the assembly capable of transmitting or receiving audio/video signals, comprising:

a mounting frame, at least one cable and at least one rear plug;

said mounting frame having a front end and a rear end with means for fixedly attaching said mounting frame to said electrically powered device, said mounting frame having at least one front socket, said front socket being electrically conductive and suitably shaped to receive an electrical cable plug, and said front socket being electrically connected through said mounting frame to said at least one cable at the rear end of said mounting frame;

said mounting frame being attached to the electrically powered device with its front socket facing forwardly to enable electrical connection to the electrically powered device from its front side;

said cable having a front end and a rear end, with the front end being electrically connected to the rear end, the front end electrically connected to said mounting frame, and the rear end electrically connected to said rear plug; and said rear plug being electrically conductive and suitably configured to be inserted into the electrical device socket in the electrically powered device.

2. The jack assembly according to claim 1, wherein said at least one front socket, said at least one cable and said at least one plug comprises plurality of front sockets, cables and plugs; said front sockets, cables and plugs are suitably configured to transmit electric audio and video signals to and from an electronic telecommunication device.

3. The jack assembly according to claim 1, wherein the front sockets, cables and rear plugs are suitably configured to transmit electric audio and video signals to and from a video cassette recorder.

4. The jack assembly according to claim 1, wherein said at least one front socket, said at least one cable and said at least one plug comprises three front sockets, cables and plugs.

5. The jack assembly according to claim 1, wherein said at least one front socket, said at least one cable and said at least one plug comprises two front sockets, cables and plugs.

6. The jack assembly according to claim 1, wherein at least one rear plug is connected to at least one cable at a right angle.

7. The jack assembly according to claim 1, wherein at least one rear plug is linearly connected to at least one cable.

8. The jack assembly according to claim 1, wherein the mounting frame has a bottom surface coated with an adhesive substance suitable for attaching it to a top surface of the electrically powered device, there further being a release liner shielding the adhesive substance before the mounting frame is attached.

9. The jack assembly according to claim 1, wherein the mounting frame has at least one rear socket, said at least one rear socket is electrically connected to said at least one front socket, and said at least one cable has a front plug electrically connected to its front end, with said front plug and said rear socket being electrically conductive and suitably configured and sized to matingly engage so as to create an electrical connection therebetween.

10. The jack assembly according to claim 9, wherein the assembly include at least one jack coupler, said at least one jack coupler comprising a front socket and a rear socket.

11. The jack assembly according to claim 10, wherein said at least one jack coupler comprises plurality of jack couplers, plurality of said jack couplers except said front sockets and rear sockets are embedded within the mounting flame.

12. The jack assembly according to claim 11, wherein the mounting frame is formed with an upper portion and a lower portion, with the upper portion and the lower portion when attached forming at least one channel within which a jack coupler may be placed.

13. The jack assembly according to claim 1, wherein at least one front socket is identified by a label attached to the front end of the mounting frame.

14. Jack assembly according to claim 13, wherein the label surrounds the socket and said label is color coded and printed so as to identify the direction of an electrical signal.

15. The jack assembly according to claim 14, wherein the label is circular, the front socket is circular in a cross section, a circumference of the label is greater than a circumference of the cross section of the front socket, the label has a circular hole with the same circumference as the cross section of the front socket, and the label, the hole in the label, and the cross section of the front socket all have the same center.

16. The jack assembly according to claim 15, wherein the labels are supplied to the user on a release liner from which the labels are peeled off, the labels having a nonadhesive color-coded front surface, and an adhesive back surface by which they are initially attached to the release liner, and after being peeled off, attached to the front end of the mounting frame around at least one front socket.

* * * * *